US007344426B1

(12) United States Patent
Dysthe

(10) Patent No.: US 7,344,426 B1
(45) Date of Patent: Mar. 18, 2008

(54) SYSTEM FOR RESCUING A PERSON FROM A BODY OF WATER

(76) Inventor: Michael Ryan Dysthe, 7666 Larkspur Dr., Buena Park, CA (US) 90620

( * ) Notice: Subject to any disclaimer, the term of this patent is extended or adjusted under 35 U.S.C. 154(b) by 0 days.

(21) Appl. No.: 11/438,862

(22) Filed: May 23, 2006

Related U.S. Application Data

(60) Provisional application No. 60/684,055, filed on May 25, 2005.

(51) Int. Cl.
*B63B 3/00* (2006.01)
*E04G 1/00* (2006.01)

(52) U.S. Cl. ..... 441/80; 182/138

(58) Field of Classification Search ..... 441/80
See application file for complete search history.

(56) References Cited

U.S. PATENT DOCUMENTS 2,817,860 A 12/1957 Fritz
4,652,246 A 3/1987 Thorgeirsson
5,158,489 A 10/1992 Araki
5,320,566 A * 6/1994 Low, Jr. ..... 441/80
5,370,565 A 12/1994 Yanez

FOREIGN PATENT DOCUMENTS

WO WO 8803495 A1 * 5/1988

* cited by examiner

*Primary Examiner*—Jesús D Sotelo
(74) *Attorney, Agent, or Firm*—Chris Papageorge

(57) ABSTRACT

The rescue system includes a mobile trailer on which are mounted telescoping hydraulic arms and a winch. A net is connected to the winch and passes over a roller mounted at the outer ends of the hydraulic arms which are vertically and horizontally movable to position the net over the body of water. The net hangs downwardly from the roller into the body of water. A ballast is attached at the lower end of the net so that the net is vertically oriented in the water. A rope connected to the lower end of the net and a set of pulleys enable the lower end of the net to be lifted to envelope a person therein. When the person is enveloped in the net, the winch is actuated via an electric motor to reel in the net and lift the net and the person out of the body of water and to a place of safety.

24 Claims, 7 Drawing Sheets

SYSTEM FOR RESCUING A PERSON FROM A BODY OF WATER

Applicant claims the benefit of the filing date of provisional application No. 60/684,055 filed May 25, 2005 by applicant, Michael Ryan Dysthe, entitled Swift Water Rescue Web, under 35 USC Section 119(e).

BACKGROUND OF THE INVENTION

The present invention relates generally to rescue systems and methods and more particularly to improved rescue systems for removing an imperiled person from a body of water in which the person is imperiled. The system is particularly suited for rescuing person who have fallen into a body of water having rapidly moving currents such as that of a river, stream or ocean.

Rescuing a person from a body of water is becoming a more common problem due to the population growth of areas which are subject to unexpected torrential rainfall. In addition, many heavily populated areas not uncommonly experience flooding due to dam rupture as well as many other causes. The resulting flood waters typically move very quickly through an area and with great force due to the high volume of water involved. Moreover, high population growth in some arid areas has required construction of dams and artificial waterways which present new hazards to residents who may become imperiled in such waterways.

Some prior art systems for rescuing a person immersed in rushing water include a net which is manually positioned to block the person's movement through the rushing water. An example of such a prior art system is disclosed in U.S. Pat. No. 5,484,313 to Rachal. The Rachal system utilizes a net to which oval carabiners are attached at four corners of the net. The carabiners are held by four persons who are positioned at opposite sides of a stream in order to laterally extend the net and position it generally perpendicular to the direction of movement of the rushing water and thereby block further movement of the imperiled person in the stream. The Rachal system also includes strobe lights mounted on the net to inform the rescuee of the presence of the net and thereby communicate to him that he should seek to grab hold of the net or insert his arms in the openings thereof. The Rachal system is an effective rescue system and advantageously does not require a rescuer to swim after the rescuee and thereby risk another life in a rescue attempt. However, an important disadvantage of this type of prior art system is that it requires active involvement on the part of the rescuee. Active cooperation by the imperiled person in the rescue attempt is often unavailable because the person may be in a state of exhaustion or in shock from the cold water and cannot think clearly enough to know what the strobe lights are signaling and ascertain from the presence of the strobe lights what he must do.

Other prior art systems for rescuing a person from a body of water utilize a helicopter. Two examples of such systems are disclosed in U.S. Pat. No. 2,817,860 to Fritz and U.S. Pat. No. 4,642,061 to Arney. Both the Arney and Fritz systems utilize a helicopter to carry a rescue structure to the body of water and lift and carry the structure and person contained therein out of the body of water and away from the rescue site. The Arney invention uses an enclosure having an opening at an end thereof (or two openings at opposite ends) thereof and which is designed to float on the body of water. The rescue structure has propelling means operable by the helicopter personnel via an umbilical cord connected to the structure. This enables the structure to be moved over the imperiled person and allow the person to be captured thereby. When this is accomplished, the entire structure and person captured therein are hoisted off and away from the rescue site by the helicopter. However, an important disadvantage of such prior art systems as the Arney invention is that in a storm situation or other type of adverse weather condition the helicopter may not be able to hoist and carry the enclosure away without tilting and capsizing it, and this may be disastrous if the helicopter is flying at a substantial height above the body of water or at another location away from the rescue site. The Fritz system uses a net having a sinking weight and a flotation structure to enable the net to be positioned under an imperiled person by the helicopter. When the net is properly positioned, the helicopter personnel raise the sinking weight to thereby enclose the person in the net. However, an important disadvantage of the Fritz system is that it requires the helicopter personnel to maneuver the net into position while in flight. Such deft maneuvering while the helicopter is hovering requires a high degree of skill and may be impossible in a storm or other adverse weather conditions. Consequently, under some conditions, these types of helicopter rescue systems may be ineffective in effectuating rescue.

Some prior art rescue devices are designed especially for rapidly moving water situations. An example of such a prior art apparatus is that disclosed in U.S. Pat. No. 5,370,565 to Yanez. The Yanez apparatus includes a net having ballast weights and which is attached to and mounted on a suspension mechanism. These structures position the net in a substantially vertical orientation in a body of water so that a person in the rushing water may grasp or become entangled in the net. The apparatus is moved into the desired position by means of two support structures situated at opposite banks of a river or the like and by persons who manually move the ropes through the support structures. The net is also pulled to one bank after the person is entangled in the net by utilizing these same structures. However, a primary disadvantage of such prior art apparatus is that it requires the use of support structures and personnel at different and relatively distal locations to set up and utilize the apparatus in the rescue. Moreover, the personnel must be well coordinated in their use of the apparatus. This may be more time consuming than the urgency of the emergency situation may allow such that the imperiled person who is rapidly moving through the water may move out of reach. In addition, in a disaster site, such a number of rescue personnel may be unavailable because the disaster situation produces other emergencies which the personnel must attend to.

Some prior art systems and methods for rescuing a person from a moving body of water have included simply throwing a flotation device to the apparently drowning person with the sole purpose of simply preventing that person from sinking. However, since hypothermia is a frequent cause of death in these situations, removing the person from the cold water as soon as possible is of crucial importance and such devices are typically unable to provide that. In addition, since falling into a rapidly moving body of water may result in serious injury to the victim and accidental injury may have contributed to the fall into the body of water, promptly removing that person from the body of water is also needed in order to provide timely medical attention and thereby reduce the chance that the injury will result in death.

Some prior art systems for rescue include throwing a rope or net to the imperiled person. Often a rope may be attached to a flotation device. However, one of the primary shortcomings of such systems and methods is that the person to be rescued is required to have and utilize a very high degree of strength in order to maintain a firm grip on such a rope or flotation device because of the relatively high speed at which he is moving through the water. This is unlikely if the imperiled person is a child. Also, this becomes difficult to accomplish if, as is common, the person in the body of water is in a weakened state due to hypothermia or due to exhaustion from attempting to swim to safety or due to injury or inhalation of water. Indeed, since it is very common for flood waters to include a very large mass of water moving at very high speeds, it becomes much more likely that an imperiled person will become quickly weakened due to exhaustion, personal injury or water inhalation. Moreover, it is often difficult for the person to be rescued to be able to grab a hold of such a rope or flotation device because of his speed relative to the rescuing person. In addition, because of this often great difference in relative speed between the rescuer and the rescuee, the rescuer is often unable to accurately throw the rope close enough to the rescuee to allow him to grab it. The high degree of force with which the flood waters push the imperiled individual require a correspondingly high degree of strength to grab a hold of and maintain a firm grip on such a rope, net or flotation device in order for the rescue to be successful. In addition, the winds may carry such flotation devices in a different direction than the water currents are carrying the victim. In such instances, there is little chance that the flotation device thrown onto the water will reach the area of the victim. Consequently, regardless of whether the rescue equipment is thrown to a drowning person from a bridge, a shore or a helicopter, these problems often prevent such a rescue operation from being successful.

A rescue system is thus needed that does not require a high degree of strength from the imperiled person in order for the rescue operation to be successful. A rescue system is also needed that is capable of rescuing an unconscious, weakened or injured person or a child from a moving body of water. A rescue system is also needed that is very mobile in order to be able to reach the site of the emergency quickly. A rescue system is also needed that may be set up easily and quickly in order to help the imperiled individual in time for the rescue operation to be successful.

SUMMARY OF THE INVENTION

It is a principal object of the present invention to provide a rescue system which can effectively rescue an imperiled individual from a body of water.

It is another object of the present invention to provide a rescue system which can effectively rescue an unconscious or otherwise passive individual from a body of water.

It is another object of the present invention to provide a rescue system which is capable of rescuing a person from a moving body of water.

It is still another object of the present invention to provide a rescue system which can be transported to the site where a person is imperiled in a body of water quickly and easily.

It is yet another object of the present invention to provide a rescue system which is powered in order to enable a single user to effectuate rescue of an imperiled individual from a body of water.

It is also an object of the present invention to provide a powered rescue system having a remote control to enable a user to operatively control the mechanized components while not proximal to those components but while instead in a position deemed optimal for observing positioning and movement of other system components in relation to the victim for more effective and efficient effectuation of the rescue operation.

It is also another object of the present invention to provide a rescue system which can be set up quickly and easily.

It is an object of the present invention to provide a rescue system which can be properly positioned for rescue quickly and easily.

It is an object of the present invention to provide a rescue system having a net which may be suspended over a body of water at a bridge or overpass.

It is an object of the present invention to provide a rescue system providing enhanced safety by utilizing components which are cushioned to prevent injury to an imperiled person who may come into contact with such components during the rescue operation.

It is also another object of the present invention to provide a rescue system which may be attached to and operated from a motorized vehicle.

The rescue system of the present invention is specifically designed to provide a rescue system complete with all the assemblies and subsystems needed for properly positioning the rescue net thereof and removing the imperiled person from the body of water in which imperiled. The system of the invention is also specifically designed to provide a complete rescue system enabling quick motorized transport to the site of the emergency. Additionally, the system provides a net for enclosing an imperiled person therein while the person is imperiled in the body of water in order to facilitate quick and safe removal of the person therefrom.

The system of the present invention is also specifically designed to provide powered net positioning and hoisting assemblies to enable a minimum number of personnel to operatively position a net in a body of water arms to be properly positioned over the body of water and thereby situated at a proper distance away from the bridge to avoid interference with the bridge structures.

Further unwinding of the net immerses it into the body of water, and a ballast at the lower end of the net allows it to be generally vertically oriented while positioned in the water. The net is lowered until it is in a position in which it blocks the path of the person carried by the water currents. The force of the moving water against the net forms a slight concavity therein for capturing the imperiled person. Once the person comes into contact with the net, the force of the water currents acting on the person and the concavity retain (to a certain degree) the person in the net. At this point, the lower part of the net and the ballast are manually pulled up by the users so as to form a pocket therein to generally envelope the person in the net and thereby securely retain the person in the net. Subsequently, the user operates the winch so as to reel in the net and thereby hoist the net and person contained therein out of the water. The vertical height of the net may be adjusted via the telescoping arms so that the net pocket and person contained therein clears the bridge railing or other type of potential obstacle. The telescoping arms are also retracted horizontally in order to bring the net pocket and person contained therein away from the body of water and over the bridge. Once the net is positioned over the bridge, the vertical height of the net is adjusted via the telescoping arms to lower the net pocket and person contained therein onto the bridge.

As is evident from the foregoing, a very important advantage of the system is that the imperiled person is not required to actively participate in the rescue operation. The imperiled person does not need to grab hold of the net nor swim toward it. This is especially important because the person to be rescued may be in such a weakened state as and remove the net containing the imperiled person therefrom. Thus, only a minimum number of personnel are required to perform the entire rescue operation quickly and effectively.

The system consists of a rescue net integrated with net positioning and hoisting assemblies as well as lifting means for enveloping the person in the net for removal from the site of the emergency. These structures and assemblies are mounted on a wheeled vehicle such as a wheeled trailer or a self propelled vehicle such as a truck in order to enable the system to be quickly transported to a site typically downstream of the area where the person is imperiled in a moving body of water. The system is generally self-contained so that nothing needs to be removed from the trailer and set up on another surface structure or attached to another structure. This relative ease of use also enables the system to be quickly taken to another site after the first rescue operation is complete and promptly be used to effectuate another rescue.

Initially, the trailer is simply parked on a bridge or other suitable roadway structure facing downstream of the water current below. Outrigger components are manually extended from the trailer so that casters at the outer ends thereof are positioned a sufficient distance from the body of the trailer to prevent tilting of the trailer under the anticipated load and thereby provide a more stable support for the system components. The rescue net is unwound from the winch drum and extended over the roller at the outer end of telescoping arms so that it generally hangs therefrom. The telescoping arms are capable of both horizontal movement and vertical movement. This horizontal adjustment feature enables the outer ends of the arms to be moved over a bridge railing or the like that would otherwise be an obstacle for other prior art systems. The horizontal adjustment feature enables the outer ends of the to be unable to grab and hold onto anything and may additionally be in such a state of shock due to hypothermia from being in the cold water that he is unable to think clearly enough to decide what exactly to do to promote rescue. This unique feature of the invention is in sharp contrast to prior art systems which typically require the person to be rescued to be alert and have a certain degree of strength necessary to grab hold of the rescue implement thrown out to him. Moreover, that person does not need to be on the surface of the water most of the time for the rescue operation to be successful. Indeed, that person may be completely submerged and not visible to the rescue personnel and yet nevertheless be captured by the net and subsequently rescued. Since potential drowning victims are not uncommonly unconscious by the time the rescue personnel are notified and arrive on the scene, the present invention provides a means for effectuating a rescue of victims who could not otherwise be rescued.

It is also an important advantage of the invention that a rescuer need not enter the water or even be proximal the body of water in order to successfully accomplish the rescue operation. Thus, the rescuer need not risk his or her own life to rescue an imperiled person. In contrast, some prior art systems require, for effective use of such prior art systems, that the rescuer actually personally attach rescue equipment to the imperiled person. With such prior art systems, the rescuer may be required to subject himself or herself to potentially serious injury from the flailing arms and legs of the imperiled individual who is often in a state of panic. In addition, with many such prior art systems, the rescuer may be subjected to the risk of injury caused by being struck by floating tree limbs or other debris moving often very quickly in the water. Moreover, it is frequently very difficult to attach a device to or personally reach a drowning person who is often being carried along very quickly by the water currents. Thus, the system of the present invention has a much greater chance of success in rescuing an imperiled person from a body of water than many other conventional prior art systems and methods.

DETAILED DESCRIPTION OF THE PREFERRED EMBODIMENT

Figure 7:
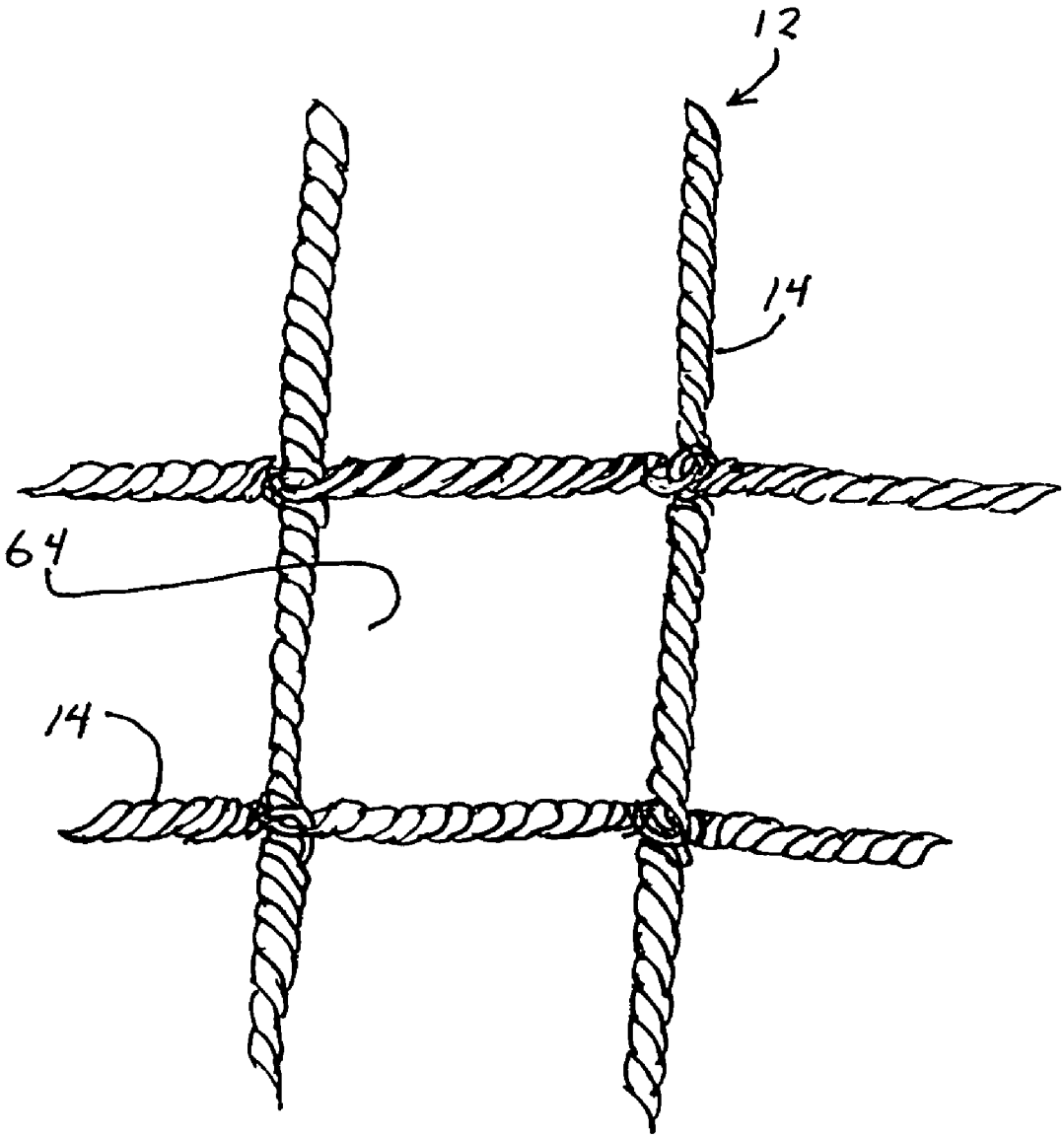
FIG. 7 is a plan view of a portion of the component net of the invention showing the interlocking weave of the cords of the net.

Referring to the drawings, the rescue system of the present invention is generally designated by the numeral 10. The system 10 includes a flexible member which is preferably simply a net 12 which includes cords 14 of circular cross-section. The cords are preferably connected together by means of an interlocking weave, as shown in FIG. 7.

The system also includes primary telescoping arms 16 and secondary telescoping arms 18. The primary arms 16 which are preferably a pair of primary telescoping arms 16 each of which include a primary rod 20 connected to and movably mounted within a medial primary tube 22 and a base primary tube 24 to provide linear movement to the primary telescoping arms 16. This enables the arms 16 to be extended so that the outer ends 26 thereof are positioned at a desired location over the body of water 28 and retracted so that the outer ends 26 are positioned at a desired location over the bridge 30. For initial placement of the system components in order to prepare for commencement of the rescue operation, the net 12 is extended over and hangs from the outer ends 26. The telescoping arms 16 thus enable the net to be positioned over the body of water 28 and thus well positioned over the general area of the imperiled person for effectuating rescue thereof. The telescoping arms 16 also enable the net to be brought back over the bridge 30 for placement of the imperiled individual onto a place of safety where first aid may be provided thereto.

The secondary telescoping arms 18 are also preferably a pair of secondary telescoping arms 18 each of which include secondary rod 32 connected to and mounted within medial secondary tube 34. The secondary rod 32 of each is connected to a rear medial upper portion 38 of each of the primary telescoping arms 16. The secondary tube is mounted on a lateral side portion 40 of the trailer 42 whereas the base primary tube is connected to the floor surface 44 of the trailer 42 and at a more medial location and inward of the base secondary tube as well as at a lower location relative to the base secondary tube 36. These connection locations enable the secondary arms 18 to provide rotational movement of the primary arms 16 relative to the trailer. Thus, the secondary arms 18 provide the primary arms 16 with vertical movement enabling the vertical height of the outer ends 26 thereof to be adjusted. This vertical height adjustment enables the net 12 to be raised to clear the bridge railing when the net 12 is initially being positioned for the rescue operation and near the end of the operation when the person is enveloped in the net. This feature also enables the net 12 to be lowered when the net is initially being positioned to bring it closer to the body of water 28 in order to allow it to be immersed therein to the desired depth.

Figure 1:
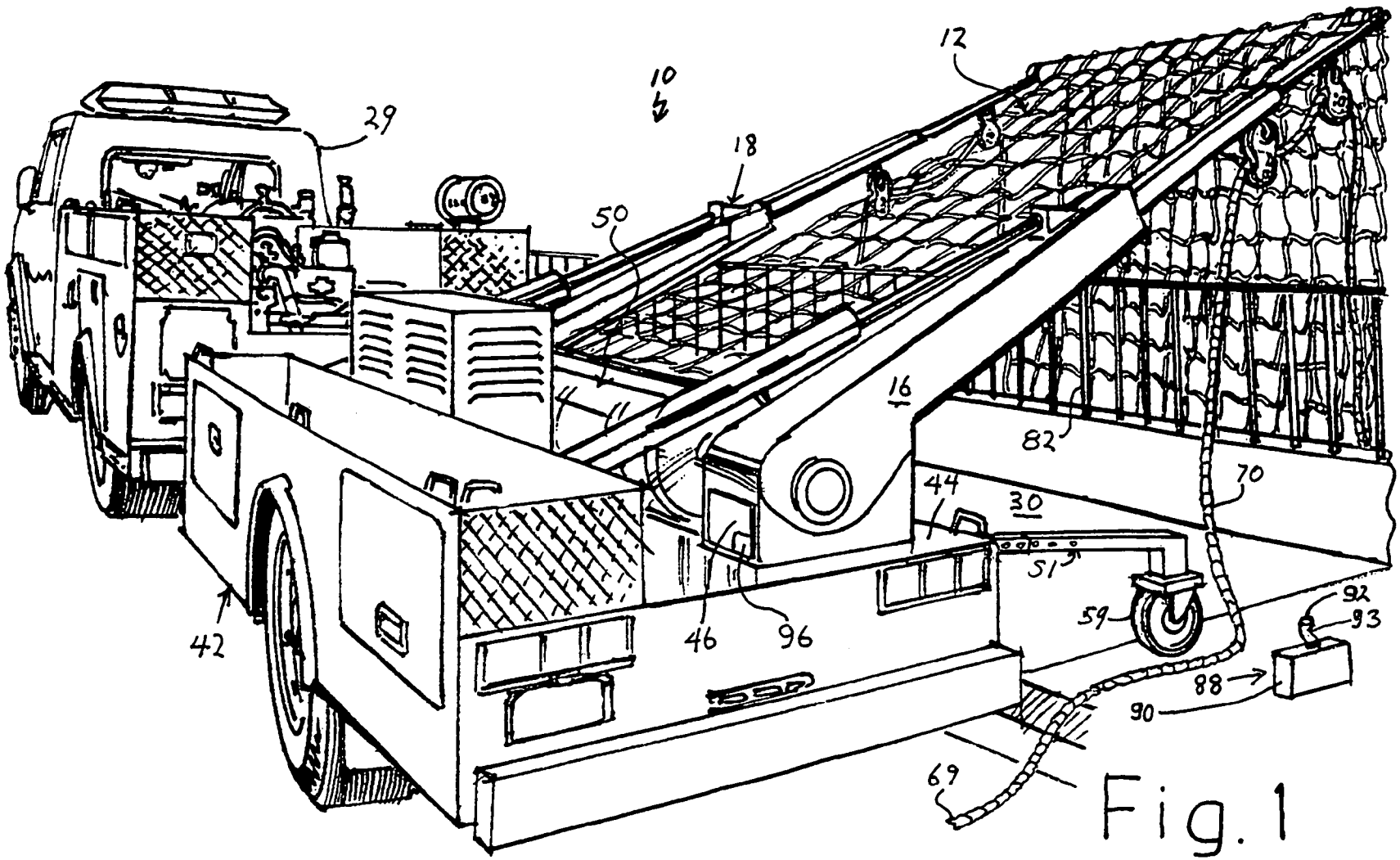
FIG. 1 is a rear perspective view of the present invention showing the trailer on which system components are mounted parked on a bridge as well as a truck to which the trailer is attached and showing the component net of the invention extending over the component telescoping arms and hanging down from the bridge.
Figure 2:
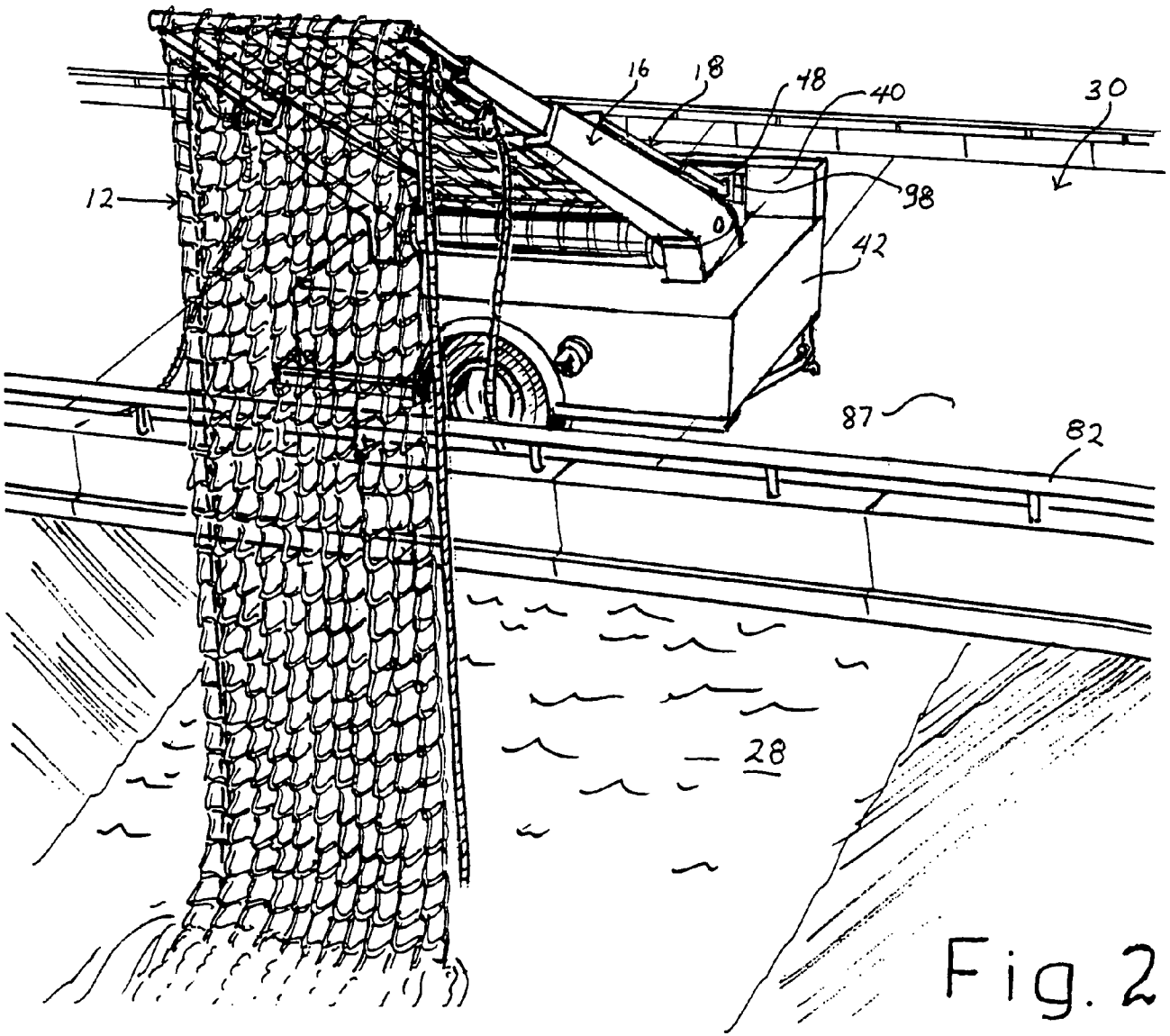
FIG. 2 is a top and side perspective view of the present invention also showing the trailer on which system components are mounted parked on a bridge and also showing the component net of the invention extending over the component telescoping arms and hanging down from the bridge site and immersed in the body of water.
Figure 3:
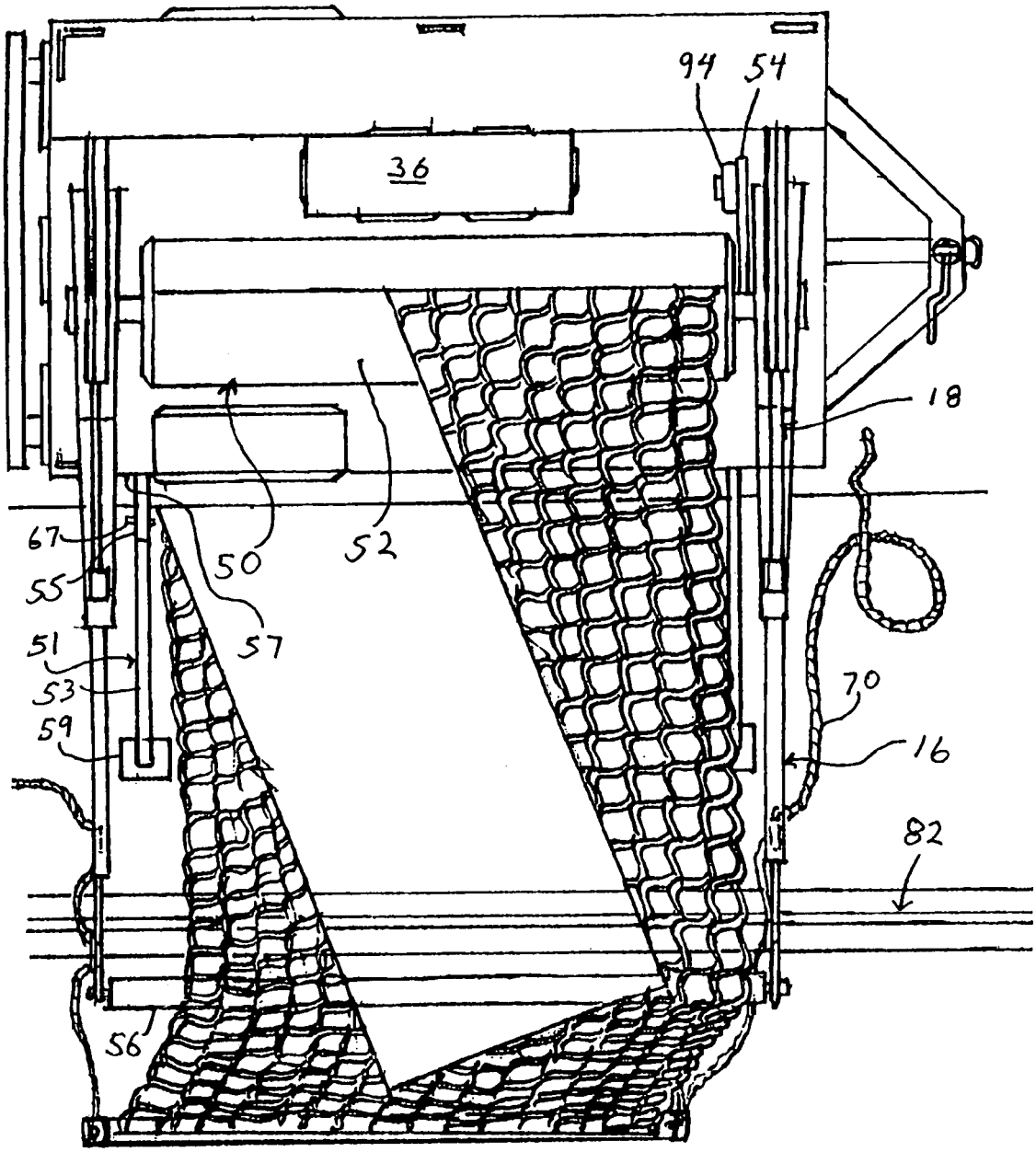
FIG. 3 is a top elevational view of the present invention showing the component trailer parked on a bridge and also showing the component net with a portion thereof cutaway to illustrate the placement of system components and the bridge railing in relation thereto.
Figure 4:
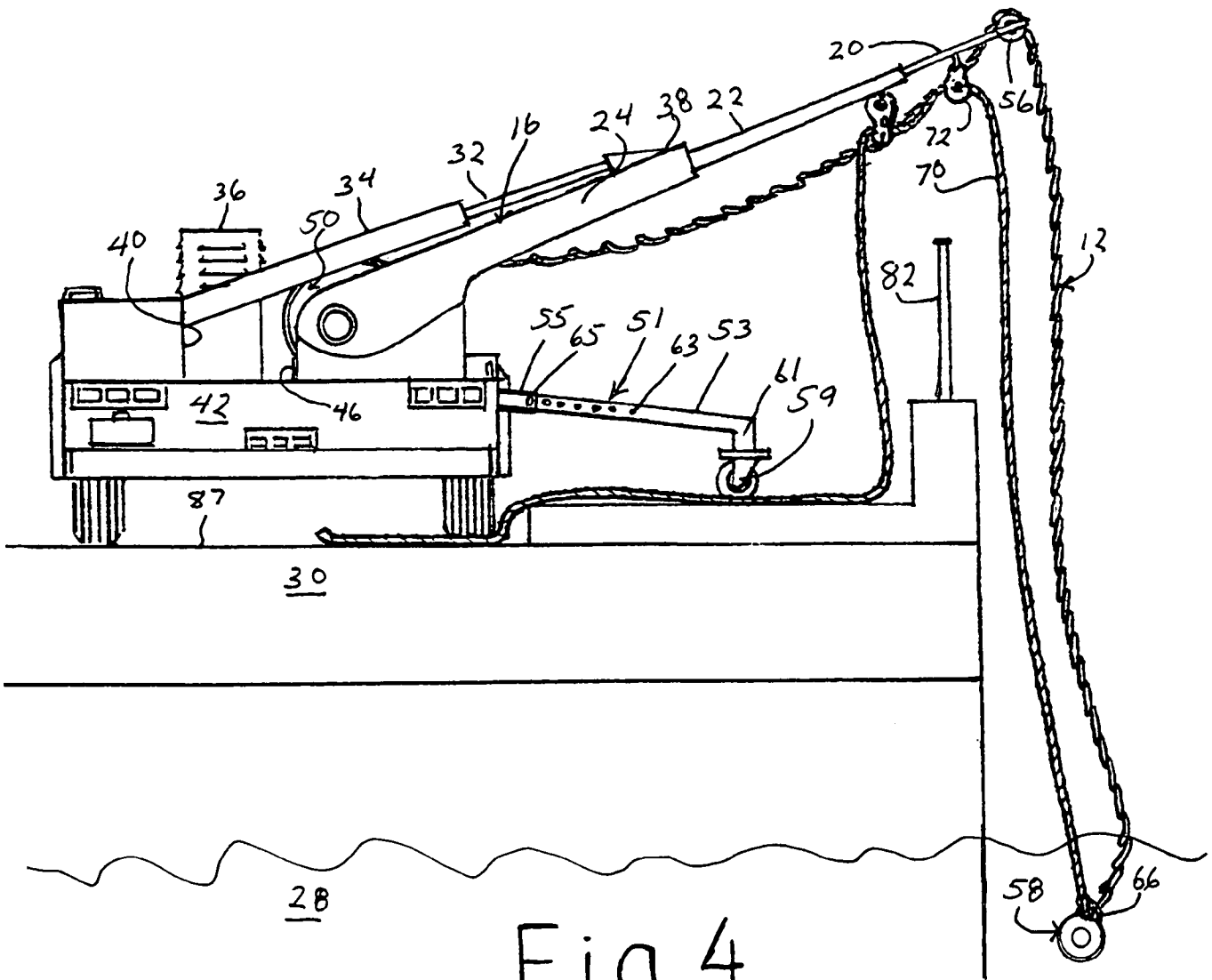
FIG. 4 is a side elevational view of the present invention showing the trailer parked on a bridge and also showing the component net extending over the telescoping arms and hanging down into the body of water.
Figure 5:
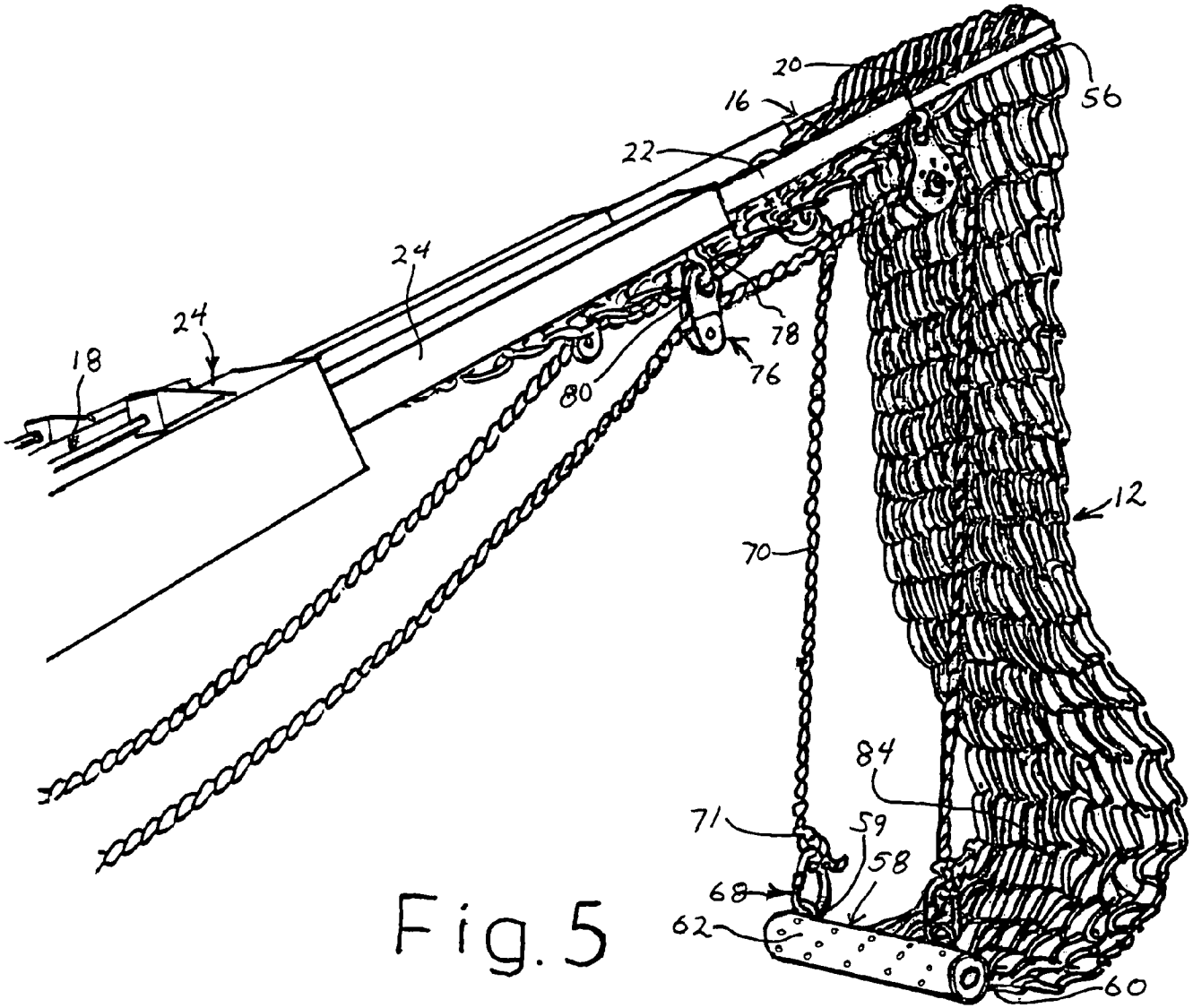
FIG. 5 is a side perspective view of portions of the telescoping arms components of the invention and the net, rope, ballast and pulley components thereof in more detail.
Figure 6:
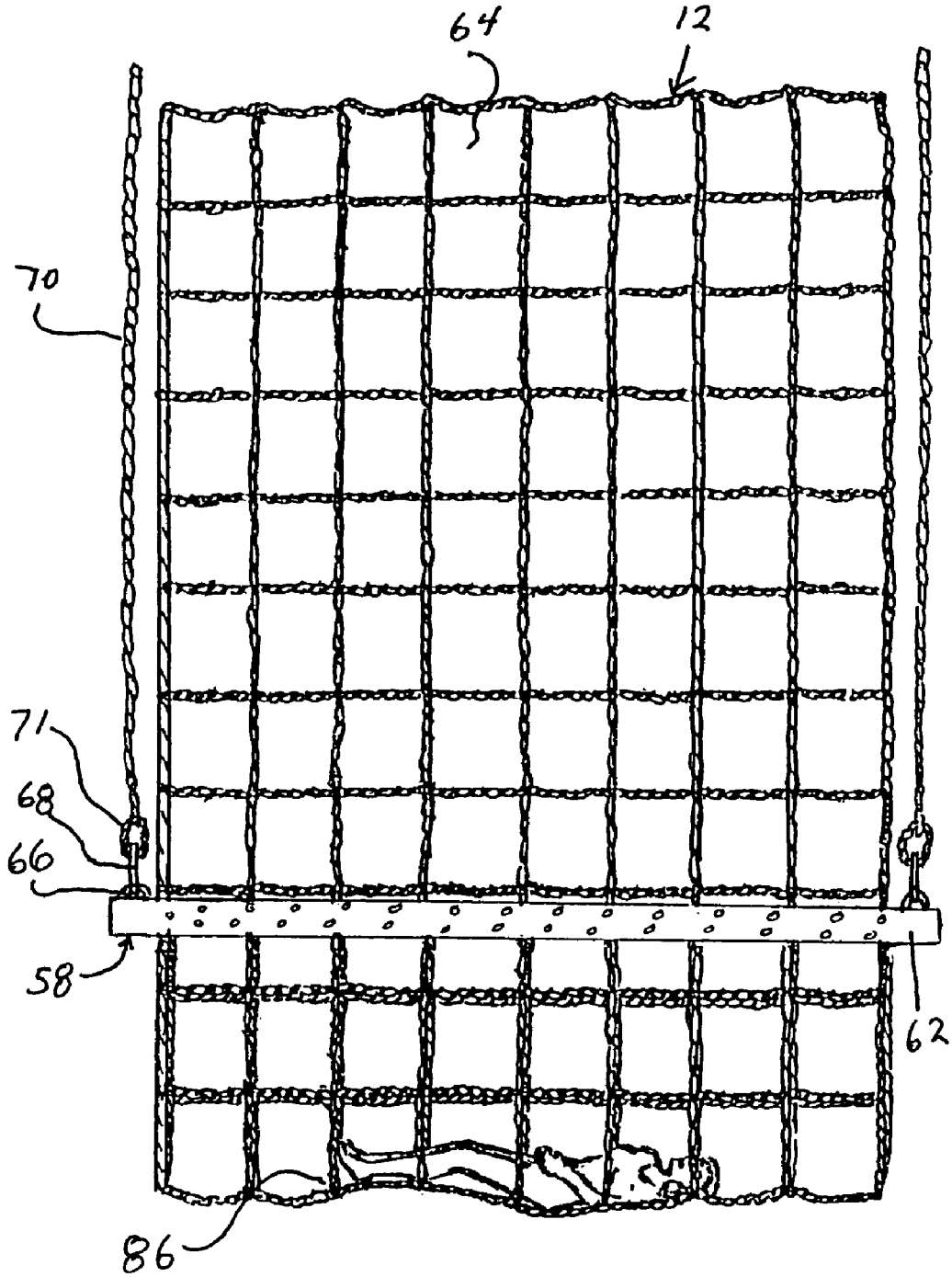
FIG. 6 is a rear elevational view of the net and ballast components of the invention illustrating the positioning of the components when forming a pocket in the net and showing an imperiled person retained in the pocket for rescue thereof.

The primary and secondary telescoping arms 16 and 18 are preferably hydraulic and preferably powered by primary motor 46 and secondary motor 48. The motors 46 and 48 are preferably electric and also mounted on the trailer 42 and attached to their corresponding telescoping arms 16 and 18 for powered operation thereof, as shown in FIG. 3. A generator 36 also mounted on the trailer 42 provides a source of electricity for the motors 46 and 48.

The net 12 is securely attached to a winch 50 and, more specifically, to a rotatable drum 52 of the winch 50. The winch 50 is operable so that the net 12 may be wound around and unwound from the drum 52. This enables the net 12 to be reeled in or reeled out so as to extend the net 12 from the winch 50 or retract it thereinto. The winch 50 is preferably powered via a winch motor 54 which is mounted on the trailer 42 and attached to the winch 50 for powered reeling in operation thereof.

A roller 56 is rotatably connected to the primary telescoping arms 16, preferably at their outer ends 26. Unwinding of the net 12 via operation of the winch 50 enables, in effect, extension of the net 12 to a sufficient degree that it comes into contact with the roller 56 which facilitates movement thereof while also minimizing abrasion. Further extension of the net 12 via operation of the winch 50 results in the net passing over and bending around the roller 56. The weight of the net in conjunction with its flexibility results in it hanging downwardly from the roller 56 and thereby from the primary telescoping arms 16. Thus, operation of the winch 50 enables the net to be lowered down from the roller 56 and into the body of water 28 to a sufficient extent that it is immersed in the water to a depth deemed optimum for blocking the path of the person carried through the body of water by the water currents. The roller 56 is preferably composed of metal or other material and is of a size and of sufficient strength to withstand the weight of the net 12 and the load the net 12 is likely to contain.

A ballast 58 is secured to the net 12 at the lower end 60 thereof. The ballast 58 is preferably composed of stainless steel or other suitable material and of a dimensional size sufficient to provide sufficiently heavy weight acting on the net 12 to enable it to both sink into the water quickly and to maintain a vertical orientation when immersed in the water. Storms or dam breakage and the like may produce such rapidly moving water that strong water currents would be able to angle the net in the water and thus detract from its effectiveness in blocking the path of the victim. The size of the ballast 58 is desirably relatively small so as to minimize the likelihood that it will come into contact with the victim and cause injury to a possibly already injured and vulnerable victim. For this reason, the ballast is also preferably coated with a rubber sheet or layer 62 so as to provide a degree of cushioning to the ballast. The rubber sheet 62 may be adhesively bonded to the ballast 58. The sheet or layer 62 is also perforated to enhance the cushioning characteristic of the ballast sheet 62. The ballast 58 is preferably solid and rounded and preferably has a cylindrical shape so that it does not present undue water resistance that would otherwise result in the water currents moving the ballast 58 and net 12 out of their desired position in the body of water 28.

The net is preferably ten feet wide and thirty feet long in order to accommodate the dimensions of a typical bridge or roadway over a river, aquaduct or other similar waterway. However, the net may also be larger i.e., twenty feet wide and sixty feet long, if desired to accommodate larger bridges or the like. The openings 64 are preferably square and sufficiently large to retain a limb of an average size person therein while sufficiently small that the torso of the average size person cannot pass therethrough. To meet these requirements, the openings are dimensioned so that they are eighteen inches square.

The ballast 58 is preferably provided with ringlets 66 at each lateral end 59 thereof. The ringlets 66 receive a pair of clips 68 for attachment of lifting ropes 70 thereto. The ropes 70 are movably anchored to the primary telescoping arms 16 via fixed pulleys 72. The fixed pulleys 72 are secured to the primary telescoping arms at lower outer end portions 74 thereof. The pulleys 72 enable inner ends 69 of the ropes to be manually pulled by a user in a horizontal direction while at the outer ends 71 the ropes 72 pull the ballast 58 and lower end 60 of the net vertically. The ropes 70 also pass through self-locking pulleys 76 which are positioned rearward of the fixed pulleys 72. The self-locking pulleys 76 are preferably securely anchored at the lower medial portions 78 of the primary telescoping arms 16. The self-locking pulleys 76 have a cam 80 actuated by pulling the ropes 70 vertically up against the cam 80 enabling rotation of the cam 80 against the rope such that it is constrained between the cam 80 and rest of the pulley 76 so as to lock the ropes 70 in position against the pulleys 76 and relative to the pulleys 76 so that the ropes 70 cannot pass further through the pulleys 76. This locking of the movement of the ropes 70 concomitantly locks the ballast 58 and lower end 60 in a desired position without the user having to hold the ropes 70 or otherwise attend to them. This leaves the user free to carry out other tasks of the rescue operation and minimizes the number of personnel required to use the system 10 to carry out a rescue operation.

In operation, once the net 12 is manually reeled out from the winch drum 52 and extended over the roller 56, the net 12 (more exactly the net lower end 60 and ballast 58) is positioned over the desired area of the body of water 28 where it is deemed the victim is likely to be by means of extension or retraction of the primary telescoping arms 16 until the outer ends 26 are properly situated over the desired area of the body of water 28. The secondary telescoping arms 18 may also be utilized, if needed, to raise the outer ends 26 sufficiently to clear the bridge railing 82 or other structure that may present an obstacle thereto. Once the ballast 58 is passed over the roller 56 so that it is on the far side of the outer ends 26, the drum 52 is allowed to freely rotate so that the weight of the ballast 58 pulls the net 12 down into the body of water 28. The net 12 is allowed to sink into the water a desired depth deemed optimum to cover the path of the victim carried along by the water currents. The force of the water currents acting on the flexible and lightweight (relative to the ballast 58) cords 14 at a generally medial area 84 of the net produces a slight concavity at the generally medial area 84 thereof. The net 12 is preferably situated so that the victim comes into contact with the net 12 which is blocking the victim's path. When the victim comes into contact with the concavity of the net 12, the force of the current in conjunction with the shape of the concavity tends to prevent the victim from passing out of the net 12. In addition, the openings 64 are also likely to catch and retain the victim's limb therein and thereby capture the victim in the net 12. Once the victim is retained in the net 12, the user pulls up on the ropes 70 thereby raising the lower end 60 of the net 12 producing a pocket 86 in the net 12 to generally envelop the victim in the net 12 and thereby generally securely retain the victim in the net 12. The winch motor 54 is actuated to reel in the net 12 and thereby hoist the net and victim out of the body of water 28. The self-locking pulleys 76 are also actuated by pulling up on the ropes 70 so that the net's lower end 60 is locked in position thereby preventing the ballast 58 (and lower end 60) from dropping and flattening out the net so as to otherwise drop the victim from the net 12. Activation of the secondary motor 48 lifts the primary telescoping arms 16 enabling the net pocket 86 and imperiled person therein to clear the bridge railing 82 or the like when the primary telescoping arms 16 are retracted via activation of the primary motor 46 thereby pulling the net 12, pocket 86 and person over the bridge. Once over the bridge 30, the pocket 86 and person contained therein may be lowered onto the bridge roadway surface 87 by unlocking the pulleys 76 and unlocking the winch 50 to allow free spinning of the drum 52. In addition, the secondary motor 48 may be activated to extend the secondary telescoping arms 18 thereby lowering the primary telescoping arms 16 toward the bridge roadway 87.

Advantageously, the system components are mounted on a mobile support platform in the form of a trailer 42. However, other types of mobile support platforms may be utilized, if desired. The trailer 42 is preferably a conventional trailer capable of being attached to a motorized vehicle 29 and being towed onto the bridge 30. This provides mobility to the system enabling it to be towed to the site of the emergency quickly. Alternatively, however, the trailer 42 may be a self propelled vehicle, if desired. After the trailer 42 is driven onto the bridge 30, outrigger 51 is utilized to provide stability to the trailer 42 enabling it to resist tilting when the telescoping arms are extended and the system 10 is under load. The outrigger 51 includes a telescoping structure or beam 53 slidably connected to a sleeve or beam 55 which is securely attached to the trailer 42 preferably at a lower lateral side 57 thereof. This enables the telescoping structure 53 to be extended from the trailer 42 thereby extending the castors 59 at the distal ends 61 thereof a desired distance from the trailer to provide the desired degree of anti-tilt leverage thereto. The telescoping structure 53 and the sleeve 55 are provided with corresponding apertures 63 in selective alignment with a hole 65 in the sleeve 55. Once in the desired position of extension, a pin 67 is inserted through one of the apertures 63 in alignment with the hole 65 to retain the telescoping structure in that desired position of extension.

The system 10 also includes a remote control 88 for the electric motors 48 and 50. The remote control 88 preferably includes a radio frequency transmitter 90 and a control stick 92 which is a joystick type of control allowing movement of the control stick 92 in two dimensions. This enables control of both motors 48 and 50 via a single manual control 92 having a handle 93 for control of the telescoping arms 16 and 18 in also two dimensions. In addition, the joystick or control stick 92 enables control of the winch motor 54, as well. The remote control subsystem 88 also includes a winch receiver 94, a primary motor receiver 96 and a secondary motor receiver 98. The winch receiver 94, the primary motor receiver 96 and the secondary motor receiver 98 are preferably radio frequency for enabling wireless operational communication between the transmitter and the receivers. This remote control feature enables the user to reel in the net 12 and control the positioning of the primary and secondary telescoping arms 16 and 18 and more desirably control the position of the outer ends 26 without having to be at the location of these motors. The user may instead be at a location proximal to the imperiled person or proximal to the outer ends 26 of the telescoping arms 16. The user may thus be located where deemed optimum to control the positioning and movement of the imperiled person, the net pocket 86 and other system components, as the situation may require.

Accordingly, there has been provided, in accordance with the invention, a rescue system which is faster, safer and more effective than many other prior art rescue systems as well as being capable of being used by a minimum number of personnel. It is to be understood that all the terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications, and variations that fall within the spirit and scope of the invention as set forth in the claims hereinbelow.

What is claimed is:

1. A system for rescuing a person from a body of water, comprising:

a mobile support platform;

a net;

means for positioning said net over the body of water, said means for positioning securely mounted on said support platform;

means for raising and lowering said net into and out of the body of water;

a ballast secured to said net;

means for raising a lower end portion of said net relative to an upper end portion of said net in order to partly envelope the person in said net after the person comes into contact therewith while immersed in the body of water;

an outrigger securely connected at an inner end thereof to said mobile support platform and positioned at an outer end thereof on a ground surface in order to prevent undesired tilting movement of said support platform under load;

means for raising said net along with the person enveloped therein in order to remove said net and the person from the body of water to thereby accomplish a desired rescue operation.

2. The system of claim 1 wherein said mobile support platform includes a trailer having wheels.

3. The system of claim 1 wherein said means for positioning further includes a roller, said net movably connected to said roller to thereby vertically support said net and allow said net to vertically move into and out of said body of water.

4. The system of claim 1 further including a remote control communicatingly connected to said means for positioning for control thereof by a user.

5. The system of claim 1 wherein said means for raising and lowering said net includes a winch securely mounted on said support platform, said winch having a drum, said net secured to said drum in order to allow said net to wind around said drum so that said net can reel in and reel out from said winch, and includes an electric motor operably connected to said drum for rotational movement thereof.

6. The system of claim 1 wherein said net is composed of cords interconnected with an interlocking weave in order to securely retain the person therein.

7. The system of claim 1 wherein said ballast is secured to said lower end portion of said net and wherein said means for raising and lowering a lower end portion of said net includes a set of ropes secured to said ballast and a set of pulleys, said set of ropes movably connected to said set of pulleys to allow said set of ropes to be manually pulled in order to raise said ballast and said lower end portion of said net to envelope the person in the net and thereby retain the person in the net in order to accomplish the rescue operation.

8. The system of claim 7 wherein said means for positioning includes a set of telescoping arms and wherein said set of pulleys are secured to said set of telescoping arms and include a set of self locking pulleys in order to selectively stop movement of said set of ropes relative to said self locking pulleys and stop movement of said lower end portion of said net relative to said upper portion of said net when the person is desirably enveloped in said net.

9. A system for rescuing a person from a body of water, comprising:

a mobile trailer having at least one pair of wheels;

a net having square openings sufficiently large to enable a limb of an average size person to pass therethrough and sufficiently small to prevent a torso of an average size person from passing therethrough;

a pair of primary telescoping arms and a pair of secondary telescoping arms for positioning said net over the body of water, said pair of primary and secondary telescoping arms being hydraulic, said pair of primary and secondary hydraulic arms securely mounted on said mobile trailer;

a winch secured to an upper end of said net for raising and lowering said net into and out of the body of water, said winch mounted on said mobile trailer;

a ballast secured to said net at a lower end portion thereof;

a rope connected to said ballast for raising a lower end portion of said net relative to the upper end portion of said net in order to form a pocket in said net to partly envelope the person in said net after the person comes into contact therewith while immersed in the body of water;

a set of pulleys in an overhanging position relative to the ballast and to the lower end portion of said net, said rope movably connected to said set of pulleys for raising the lower end portion of said net along with the person enveloped therein in order to enable removal of said net and the person from the body of water to thereby effectuate rescue of the person from an imperiled situation in the body of water.

10. The system of claim 9 further including a roller rotatably mounted on said set of primary telescoping arms at outer end portions thereof, said net positioned to pass on and over an outer surface of said roller to allow said net to move relative to and on said roller in order to enable said roller and said set of primary telescoping arms to vertically support said net and allow said net to vertically move into and out of said body of water.

11. The system of claim 10 wherein said pair of secondary telescoping arms are movably connected to said pair of primary telescoping arms to provide rotational movement of said pair of primary telescoping arms relative to said mobile trailer in order to provide adjustment of vertical height of said primary telescoping arms, said roller rotatably connected to said pair of primary telescoping arms, said pair of primary telescoping arms and said pair of secondary telescoping arms being hydraulic and operated via a telescoping arm electric motor.

12. The system of claim 9 further including:

a telescoping arm electric motor operatively connected to said set of primary telescoping arms and to said set of secondary telescoping arms;

a winch electric motor operatively connected to said winch;

a remote control wirelessly communicatingly connected to said telescoping arm electric motor and to said winch electric motor for control thereof by a user.

13. The system of claim 12 wherein said remote control includes a control stick having a handle for manual operation thereof and a radio frequency transmitter and further including a telescoping arm receiver for receiving radio frequency signals from said transmitter and electrically connected to said telescoping arm electric motor for operational control thereof and a winch receiver for receiving radio frequency signals from said transmitter and electrically connected to said winch electric motor for operational control thereof.

14. The system of claim 9 wherein said net is approximately ten feet in width and approximately thirty feet in length and composed of cords circular in cross-section and interconnected with an interlocking weave in order to securely retain the person therein and the openings of said net approximately eighteen inches square.

15. The system of claim 9 further including an outrigger securely connected at an inner end thereof to said mobile support platform and positioned at an outer end thereof on a ground surface in order to prevent undesired tilting movement of said support platform under load, said outrigger including telescoping structures including a first beam having a hole and a second beam having apertures in selective alignment with said hole and a pin for insertion into said hole and selective one of said apertures for securing said first and second beams together in a position in which the telescoping structures have a desired length to provide a desired degree of anti-tilt thereto.

16. The system of claim 9 further including a rubber sheet covering said ballast for providing padding thereto in order to minimize risk of injury from the person coming into contact therewith during rescue operations.

17. A system for rescuing a person from a body of water, comprising:

a mobile support platform;

a net;

means for positioning said net over the body of water, said means for positioning securely mounted on said support platform and including a set of telescoping arms having outer end portions, said net movably connected to said set of telescoping arms at said outer end portions to enable said net to hang vertically from said outer end portions and to move relative to said outer end portions;

means for raising and lowering said net into and out of the body of water;

a ballast secured to said net;

means for raising a lower end portion of said net relative to an upper end portion of said net in order to partly envelope the person in said net after the person comes into contact therewith while immersed in the body of water;

means for raising said net along with the person enveloped therein in order to remove said net and the person from the body of water to thereby accomplish a desired rescue operation.

18. The system of claim 17 wherein said means for positioning further includes a roller rotatably mounted on said set of telescoping arms at said outer end portions, said net movably connected to said roller to thereby vertically support said net and allow said net to vertically move into and out of said body of water.

19. The system of claim 17 wherein said set of telescoping arms includes a pair of primary telescoping arms and a pair of secondary telescoping arms, said pair of secondary telescoping arms movably connected to said pair of primary telescoping arms for enabling relative movement therebetween in order to provide adjustment of vertical height of said primary telescoping arms, said roller rotatably connected to said pair of primary telescoping arms, said pair of primary telescoping arms and said pair of secondary telescoping arms being hydraulic and operated via a telescoping arm electric motor.

20. The system of claim 19 further including a remote control communicatingly connected to said telescoping arm electric motor for control thereof by a user.

21. A system for rescuing a person from a body of water, comprising:

a mobile support platform;

a net;

means for positioning said net over the body of water, said means for positioning securely mounted on said support platform;

means for raising and lowering said net into and out of the body of water including a winch securely mounted on said support platform, said winch having a drum, said net secured to said drum in order to allow said net to wind around said drum so that said net can reel in and reel out from said winch, and including an electric motor operably connected to said drum for rotational movement thereof;

a ballast secured to said net;

means for raising a lower end portion of said net relative to an upper end portion of said net in order to partly envelope the person in said net after the person comes into contact therewith while immersed in the body of water;

means for raising said net along with the person enveloped therein in order to remove said net and the person from the body of water to thereby accomplish a desired rescue operation.

22. A system for rescuing a person from a body of water, comprising:

a mobile support platform;

a net;

means for positioning said net over the body of water, said means for positioning securely mounted on said support platform;

means for raising and lowering said net into and out of the body of water;

a ballast secured to said net;

means for raising a lower end portion of said net relative to an upper end portion of said net in order to partly envelope the person in said net after the person comes into contact therewith while immersed in the body of water;

an outrigger securely connected at an inner end thereof to said mobile support platform and positioned at an outer end thereof on a ground surface in order to prevent undesired tilting movement of said support platform under load, said outrigger including telescoping structures including a first beam having a hole and a second beam having apertures in selective alignment with said hole and a pin for insertion into said hole and selective one of said apertures for securing said first and second beams together in a position in which the telescoping structures have a desired length to provide a desired degree of anti-tilt thereto;

means for raising said net along with the person enveloped therein in order to remove said net and the person from the body of water to thereby accomplish a desired rescue operation.

23. A system for rescuing a person from a body of water, comprising:

a mobile support platform;

a net;

means for positioning said net over the body of water, said means for positioning securely mounted on said support platform;

means for raising and lowering said net into and out of the body of water;

a ballast secured to said net;

means for raising a lower end portion of said net relative to an upper end portion of said net in order to partly envelope the person in said net after the person comes into contact therewith while immersed in the body of water;

means for raising said net along with the person enveloped therein in order to remove said net and the person from the body of water to thereby accomplish a desired rescue operation;

a remote control including a control stick having a handle for manual operation thereof, said remote control wirelessly communicatingly connected to said means for positioning and said means for raising and lowering said net for control thereof by a user located at any desired location remote from the system.

24. A system for rescuing a person from a body of water, comprising:

a mobile support platform;

a net;

means for positioning said net over the body of water, said means for positioning securely mounted on said support platform;

means for raising and lowering said net into and out of the body of water;

a ballast secured to said net;

means for raising a lower end portion of said net relative to an upper end portion of said net in order to partly envelope the person in said net after the person comes into contact therewith while immersed in the body of water, said means for raising a lower end portion including a set of ropes and a set of self locking pulleys for receiving said set of ropes, said set of self locking pulleys secured to said means for positioning in order to selectively stop movement of said set of ropes relative to said self locking pulleys and selectively stop movement of said lower end portion of said net relative to said upper portion of said net when the person is desirably enveloped in said net solely via manual positioning of said set of ropes relative to said set of self locking pulleys;

means for raising said net along with the person enveloped therein in order to remove said net and the person from the body of water to thereby accomplish a desired rescue operation.

* * * * *